United States Patent [19]

Beal

[11] Patent Number: 5,046,709

[45] Date of Patent: Sep. 10, 1991

[54] APPARATUS FOR CUTTING OR STACKING WEB MATERIALS

[75] Inventor: Lawrence E. Beal, Wadsworth, Ohio

[73] Assignee: Illinois Tool Works, Inc., Glenview, Ill.

[21] Appl. No.: 340,867

[22] Filed: Apr. 17, 1989

[51] Int. Cl.[5] ..... B65H 29/46

[52] U.S. Cl. ..... 270/30; 270/39

[58] Field of Search ..... 270/30, 31, 39; 271/187, 200; 493/352, 358, 937, 408

[56] References Cited

U.S. PATENT DOCUMENTS

| | | | |
|---|---|---|---|
| 3,281,146 | 10/1966 | Bridge | 271/200 |
| 3,768,800 | 10/1973 | Gutknecht | 270/30 |
| 3,877,628 | 4/1975 | Asselin | 270/30 |
| 4,712,787 | 12/1987 | Princiotta et al. . | |
| 4,830,351 | 5/1989 | Stanislaw | 270/31 |

FOREIGN PATENT DOCUMENTS

| | | | |
|---|---|---|---|
| 1243035 | 8/1960 | France . | |
| 1598411 | 7/1970 | France . | |
| 59-128153 | 7/1984 | Japan | 271/200 |
| 919121 | 2/1963 | United Kingdom | 271/200 |
| 964854 | 7/1964 | United Kingdom . | |

*Primary Examiner*—John T. Kwon
*Assistant Examiner*—Therese M. Newholm
*Attorney, Agent, or Firm*—Wood, Herron & Evans

[57] ABSTRACT

Apparatus for stacking a web in a cut or zigzag folded condition. A supply conveyor overlies a reciprocating transport conveyor. The transport conveyor passes over a skid onto which cut or stacked web is to be disposed. The velocity of reciprocation of the transport conveyor is timed to the speed of the supply conveyor. The transport conveyor is an endless belt having brakes to alternatively seize its upper or lower run as the conveyor is reciprocated.

3 Claims, 2 Drawing Sheets

APPARATUS FOR CUTTING OR STACKING WEB MATERIALS

This invention relates to apparatus for stacking a web in a cut or zigzag folded condition.

BACKGROUND OF THE INVENTION

U.S. Pat. No. 3,768,800 discloses apparatus for stacking a continuous web material in a zigzag condition or in cut sheets. A single belt passing over four pulleys receives the web and transports over a skid onto which the web is to be deposited. The transport is effected by reciprocating two of the pulleys that are spaced apart by approximately the length of the skid. Means are provided for selectively rotating certain of the pulleys to effect the deposit of cut sheets onto the skid or to effect the zigzag folding onto the skid.

The principal problem of the apparatus of U.S. Pat. No. 3,768,800 is that because of the length of the belting in the conveyors, the irregularity in the stock, and the number of reversals of direction the single belt is required to make, it is very difficult to track the belting, that is, to have it stay centered on the pulleys.

BRIEF DESCRIPTION OF THE INVENTION

The object of the present invention has been to overcome the disadvantages of the system of U.S. Pat. No. 3,768,800 and to provide a folder-stacker that is more reliable and free from operator and maintenance problems that arise in maintaining a continuous operation.

The objective of the present invention is attained by providing two endless conveyors each passing around only two pulleys. An upper or supply conveyor is mounted on pulleys having stationary axes. Its function is to deliver the web to a transport conveyor disposed below it. The transport conveyor consists of an endless belt passed around two pulleys which maintain the distance between their axes but which reciprocate out from under the supply conveyor to capture the web and deposit it on a skid over which the transport pulley passes as it reciprocates. Brakes are mounted adjacent to the upper and lower runs of the transport conveyor endless belt and are selectively applied to cause the upper run to move with respect to the pulleys as the transport conveyor is reciprocated.

A knife is fixedly mounted below the leading end of the transport conveyor and a moving knife is carried by the frame that moves the transport conveyor. As the transport conveyor returns to its position below the supply conveyor, the two knives will meet and cut transversely across the web to form sheets that drop onto the skid. One of the knives can be adjusted so that, upon return of the transport conveyor, the knives do not engage. This condition is required when the apparatus is converted to a zigzag folding apparatus with no cutting taking place.

BRIEF DESCRIPTION OF THE DRAWINGS

Referring to FIG. 1, a supply conveyor 10 overlies a transport conveyor 12. A skid 13 is positioned alongside the conveyors, the skid 13 having an elevator 14 that enables the skid to descend as the web is stacked upon it. The supply conveyor 10 consists of an endless belt 15 passing around two pulleys 16 and 17. The belt 15 presents an upper run 18 that supplies a web 20 to the transport conveyor 12. The forward pulley 17 is driven by a motor 25 through a clutch 24.

Figure 1:
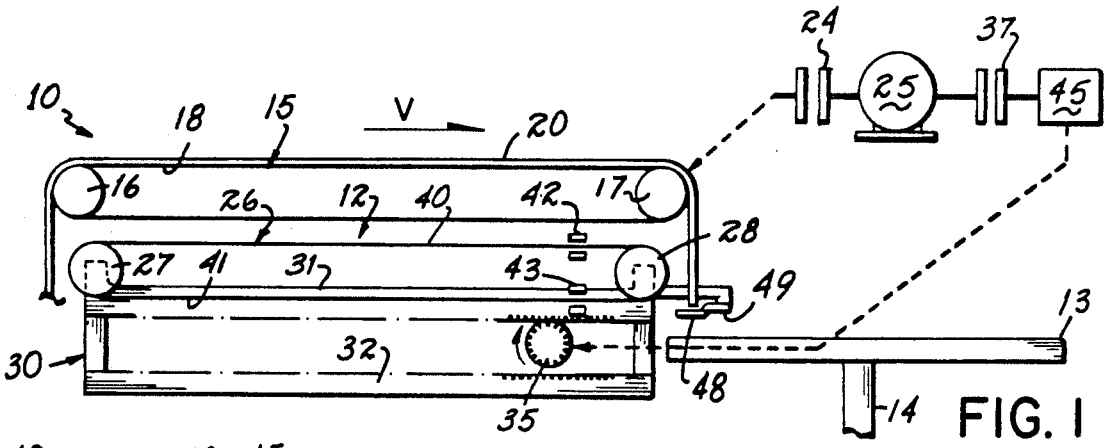
FIGS. 1-5 are diagrammatic illustrations of the apparatus of the invention in a sheet cutting mode of operation.

The transport conveyor 12 consists of an endless belt 26 passing over two pulleys 27 and 28 which are mounted on a frame 30. The frame 30 has an upper rack 31 and a lower rack 32. A pinion 35 is adapted to be raised to engage the upper rack or lowered to engage the lower rack. The pinion always rotates in the same direction and is directly connected through a clutch 37 to the motor 25.

The belt 26 has an upper run 40 and a lower run 41. Brakes 42 are mounted on a fixed frame and are adapted to clamp against the upper run 40 to prevent its movement as the frame 30 is reciprocated.

Brakes 43 are mounted on the same fixed frame and are adapted to clamp against the lower run 41 to block movement of the belt as the frame and pulleys are reciprocated.

Two-to-one reduction gearing 45 (or sprocket and chain) is provided in the transmission between the motor 25 and the pinion 35 to reduce the velocity of reciprocation of the frame 30 during one motion in the zigzag folding operation. The gearing is selectively applied, for it is needed in only one operation of the system.

A knife 48 is mounted on the fixed frame and extends transversely across the conveyors. A cooperating blade 49 is fixed to the reciprocating frame 30 so that when it is operatively positioned for cutting, as shown in FIG. 1, it will sever the web upon the return stroke of the frame 30.

The operation of the invention in the cut and stack mode is illustrated in FIGS. 1-5. In FIG. 1, the motor 25 is in continuous operation. Clutch 24 is closed to cause the supply conveyor to operate with the upper run moving at a velocity V toward the skid 13. It brings the leading edge of the web to the position shown in FIG. 1 where it can be engaged and picked up by the leading end of the transport conveyor 12 when frame 30 reciprocates.

Figure 2:
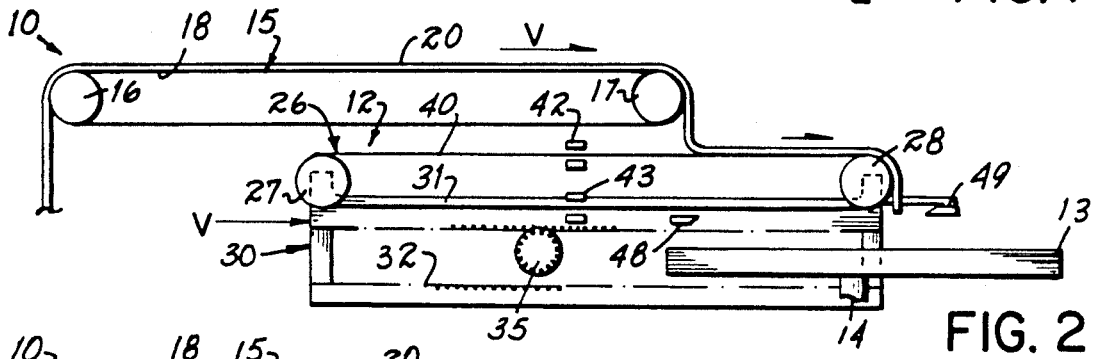

As shown in FIG. 2, while the supply conveyor 10 continues to run, the transport conveyor frame 30 is driven at velocity V to carry it over the skid 13 while carrying the web over the skid. To this end, the movement of the transport conveyor 12 is effected by raising the pinion 35 to engage the upper rack 31 with the clutch 37 closed. The reduction gearing 45 is inoperative.

Figure 3:
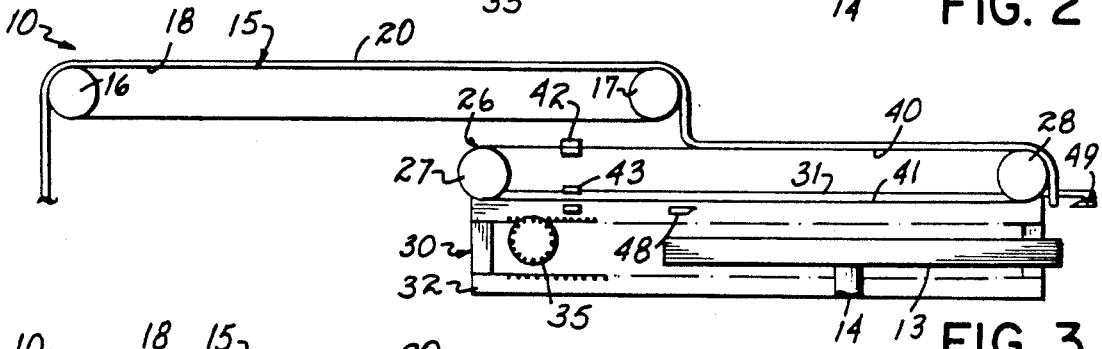
Figure 4:
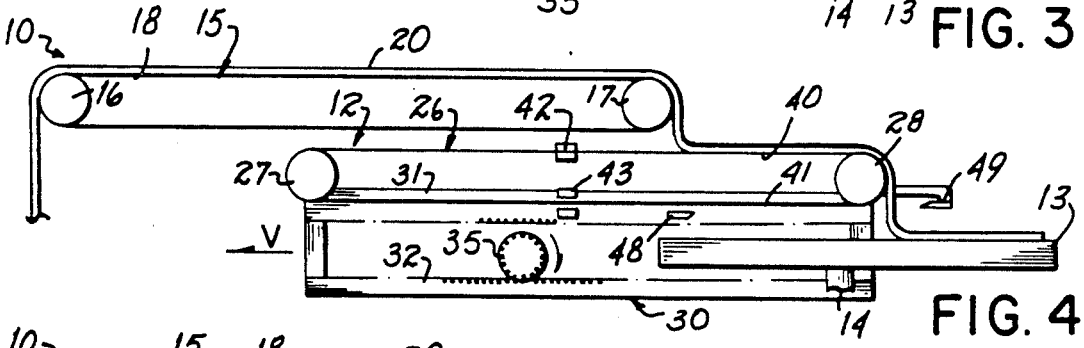
Figure 5:
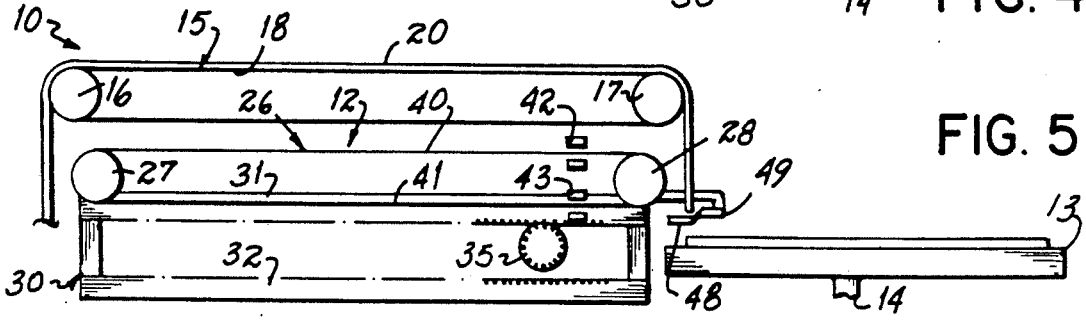
Figure 6:
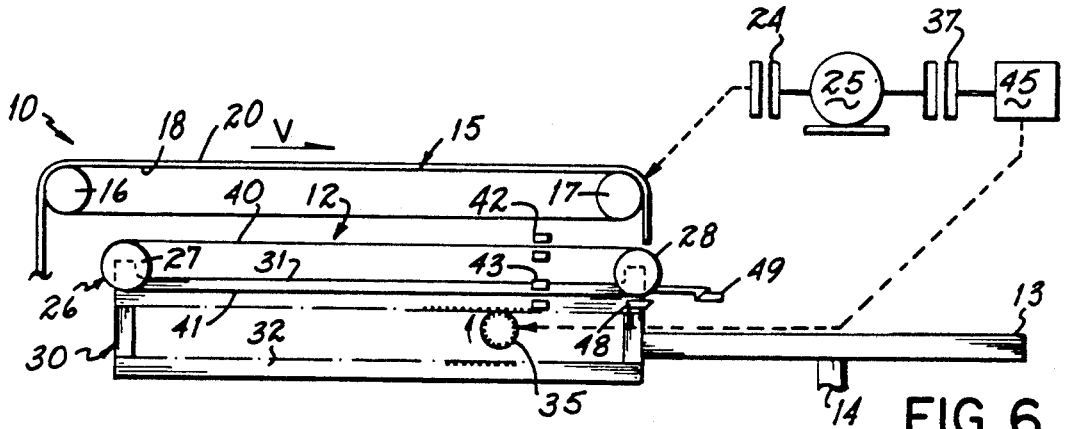
FIGS. 6-10 are diagrammatic illustrations of the apparatus in a zigzag folding mode of operation.
Figure 7:
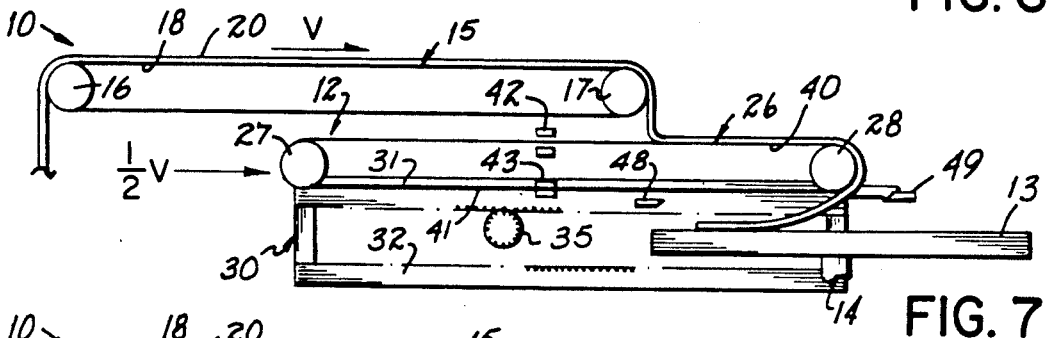

As shown in FIG. 3, the upper brake 42 is closed after the frame 30 has carried the transport conveyor all the way across the skid. Referring to FIG. 4, the clutch 24 to the supply conveyor 10 is opened, stopping the supply conveyor. The pinion 35 is dropped down to the lower rack 32 to cause the lower rack to move to the left away from the skid. The movement of the lower rack carries the frame 30 and the transport conveyor to the left. Since the upper run 40 is braked, the belt moves relative to the pulleys with the upper run moving rightward relative to the pulleys to pay out the web onto the skid 13. When the transport conveyor completes its return, the knife blade 49 contacts knife blade 48 to slice through the web and drop it on the skid as shown in FIG. 5. This operation is repeated so as to stack cut sheets of the web on the skid while the skid descends to accommodate the height of the load of sheets upon it.

The zigzag fold operation is best understood by reference to FIGS. 6–10. The operation begins with the closing of the clutch 24 to cause the upper run of the supply conveyor 10 to move toward the skid 13 at a velocity V. With respect to the transport conveyor, four operations are effected. The pinion is raised to engage the upper rack 31. The clutch 37 is thereafter engaged to cause the frame to move outward across the skid. The lower brake 43 is closed upon the lower run 41, thereby causing the upper run 40 to move to the right toward the skid. The two-to-one gear box 95 is shifted to reduce the speed of the pinion to one-half its normal speed. The combination of factors causes the web to pass around the transport conveyor and to be laid onto the skid.

Figure 8:
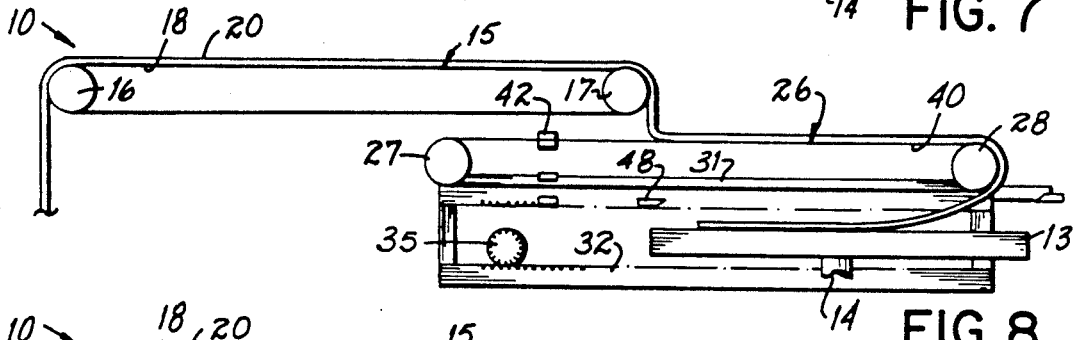
Figure 9:
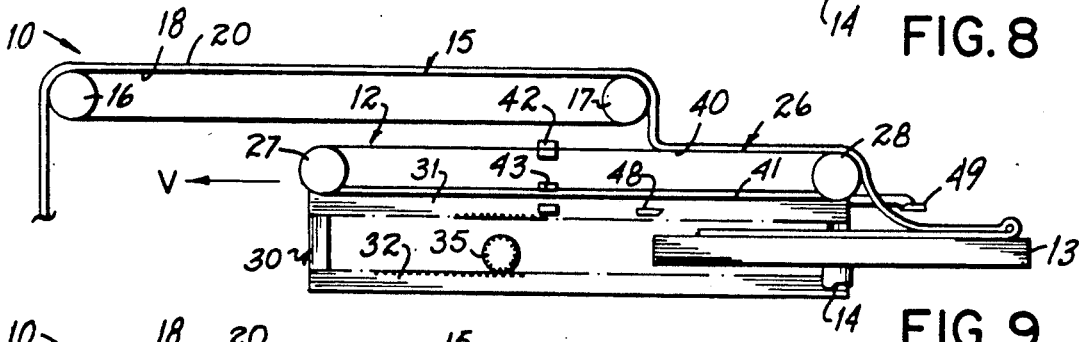

As shown in FIG. 8, after the completion of the outer stroke the clutch 37 is temporarily opened, the two-to-one reduction gearing is disengaged, the lower brake is disengaged and the brake 42 to the upper run 40 is engaged. The pinion is lowered to engage the lower rack 32 and the clutch 37 is thereafter engaged to cause the frame 30 and the transport conveyor to move to the left. The closing of the upper clutch causes the web to be paid out, as shown in FIG. 9, onto the first layer of web as the transport conveyor returns to its original position.

Figure 10:
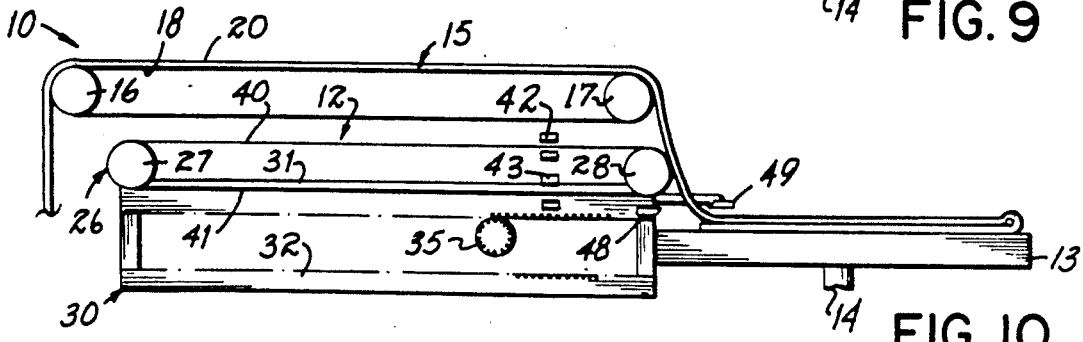

In FIG. 10, the transport conveyor has returned to its original position and the brakes and clutches are opened. It can be seen that in this condition the knife blade 49 which has earlier been moved to the right on the frame 30, no longer can contact the cooperating blade 48 so that no cutting occurs. Thereafter, the operation is repeated with the skid descending as before until a zigzag folded stack of the desired height is created. Thereafter, an operator with a manual knife can slice through the web and the skid removed.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. Apparatus for stacking a web in a cut or a zigzag folded condition comprising:

a skid, an endless supply belt, said supply belt having a horizontal upper run and a discharge end adjacent said skid, means for driving said belt to move said upper run toward said skid, an endless transport belt below said supply belt, said transport belt having a horizontal upper run and a horizontal lower run, means for clamping said transport belt upper run, means for clamping said transport belt lower run, and means for horizontally reciprocating said transport belt with respect to said supply belt, said means for clamping said upper run and said means for clamping said lower run being selectively operable to provide a cut and stack operation when said upper run is intermittently clamped and to provide a zigzag fold operation when said upper and lower runs are alternatively clamped.

2. Apparatus as in claim 1 further comprising:

a fixed knife blade adjacent said skid, a frame for said transport belt, a movable knife blade carried by said frame to cut said web against said fixed blade as said transport blade and frame return to a position below said supply belt.

3. Apparatus as in claim 1 further comprising:

means for synchronizing the velocity of said driving means for said supply belt to the velocity of said reciprocating means to move said transport belt at one-half the velocity of said supply belt upper run as said transport belt is moved to a position over said skid.

* * * * *